US011346602B2

(12) United States Patent
Prosser

(10) Patent No.: US 11,346,602 B2
(45) Date of Patent: May 31, 2022

(54) SYSTEM AND METHOD FOR NATURAL GAS AND NITROGEN LIQUEFACTION WITH DUAL OPERATING MODES

(71) Applicant: Neil M. Prosser, Lockport, NY (US)

(72) Inventor: Neil M. Prosser, Lockport, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 1 day.

(21) Appl. No.: 17/120,376

(22) Filed: Dec. 14, 2020

(65) Prior Publication Data

US 2021/0348837 A1 Nov. 11, 2021

Related U.S. Application Data

(60) Provisional application No. 63/020,044, filed on May 5, 2020.

(51) Int. Cl.
*F25J 1/02* (2006.01)
*F25J 1/00* (2006.01)

(52) U.S. Cl.
CPC ..... *F25J 1/0022* (2013.01); *F25J 1/0015* (2013.01); *F25J 1/0042* (2013.01); *F25J 1/0072* (2013.01)

(58) Field of Classification Search
CPC ..... F25J 1/0022; F25J 1/0015; F25J 1/0245; F25J 1/0281; F25J 1/0202; F25J 1/0072; F25J 2210/06; F25J 2215/60; F25J 2210/02
See application file for complete search history.

(56) References Cited

U.S. PATENT DOCUMENTS 5,916,260 A * 6/1999 Dubar ..... F25J 3/0257 62/912
2016/0109180 A1* 4/2016 Hirose ..... F25J 1/0224 62/651
2017/0038136 A1* 2/2017 Turney ..... F25J 1/0022

* cited by examiner

*Primary Examiner* — Brian M King
(74) *Attorney, Agent, or Firm* — Robert J. Hampsch

(57) ABSTRACT

Liquefier arrangements configured for co-production of both liquid natural gas (LNG) and liquid nitrogen (LIN) configured to operate in two distinct operating modes are provided.

11 Claims, 4 Drawing Sheets

SYSTEM AND METHOD FOR NATURAL GAS AND NITROGEN LIQUEFACTION WITH DUAL OPERATING MODES

CROSS REFERENCE TO RELATED APPLICATIONS

This application claims the benefit of and priority to U.S. provisional patent application Ser. No. 63/020,044 filed May 5, 2020 the disclosure of which is incorporated by reference.

TECHNICAL FIELD

The present invention relates to liquefaction, and more particularly, to a liquefier arrangement capable of producing liquid natural gas (LNG) and liquid nitrogen (LIN). Still more particularly, the present system and method relates to a liquefier arrangement configured for co-production of both LNG and LIN in two distinct operating modes.

BACKGROUND

There are various industrial gas business opportunities where the production of both liquid natural gas (LNG) and liquid nitrogen (LIN) is required. U.S. provisional patent application Ser. No. 62/976,049 filed Feb. 13, 2020, the disclosure of which is incorporated by reference herein, shows examples of liquefier arrangements capable of a liquefaction cycle that co-produces LNG and LIN.

As disclosed in U.S. provisional patent application Ser. No. 62/976,049; liquefier arrangements capable of a liquefaction cycle that co-produce both LNG and LIN require a separate passage in a conventional nitrogen liquefier that is employed to cool and liquefy the natural gas. This modification typically requires changing the brazed aluminum heat exchanger (BAHX) arrangement to allocate one of the passages to cool the natural gas feed and then reallocate a portion of the high pressure gaseous nitrogen feed passages or layers. Since LNG is sufficiently subcooled at about 110 K it is withdrawn from the BAHX at a location corresponding to a temperature somewhat warmer than the cold end of the BAHX where the temperature is about 95 K to 100 K required to liquefy the nitrogen.

The natural gas feed is preferably pre-purified for removal of carbon dioxide and other contaminants as well as removal of minor amounts of moisture prior to entry in the cold box. Other potential contaminants may include $H_2S$, mercaptans, mercury and mercury compounds which also must be removed or reduced to a satisfactory level. Usually, heavier hydrocarbons are sufficiently extracted in NGL facilities prior to supply. If this is not the case, a significant modification in the liquefier design would be required in order to capture and remove the heavier hydrocarbons at an intermediate temperature. Also, if the feed natural gas is at a low pressure, the liquefaction process may optionally require pre-compression of the natural gas feed, preferably to a pressure of about 450 psia to enable the use of a modified nitrogen liquefier design. If the pressure of the natural gas feed is below about 450 psia, the temperature difference in the natural gas condensing zone of the heat exchanger may exceed the allowable limits for many BAHX designs. Alternatively, if the feed natural gas is supplied at a lower pressure, the liquefier design would have to be changed so that at least the condensing portion of the heat exchanger is of a different design, for example, a stainless steel brazed heat exchanger or a stainless steel spiral wound heat exchanger. Thus, to avoid the much more expensive heat exchangers and to achieve improved efficiencies, natural gas pre-compression is preferred. needed when it is supplied at lower pressures. The further compressed natural gas feed would optionally be cooled in an aftercooler to remove the heat of compression.

During liquefaction of a high pressure natural gas feed pressures, the refrigeration demand of the warm turbine is greatly increased. This increased refrigeration demand is because natural gas liquefaction or pseudo-liquefaction is now taking place at a temperature above the exhaust temperature of the warm turbine. As a result, the warm turbine is larger and passes significantly more flow. The cold turbine refrigeration primarily is providing refrigeration for liquefaction or pseudo-liquefaction of the nitrogen while the warm turbine refrigeration primarily provides refrigeration for natural gas liquefaction or pseudo-liquefaction. This means that independent variation in the LNG demand and the LIN demand likely results in independent variation of the demand for refrigeration from each turbine and the optimal warm turbine to cold turbine flow ratio will vary significantly, depending on the output demand for LNG and LIN. The prior art liquefier arrangement capable of a liquefaction cycle that co-produces both LNG and LIN disclosed in U.S. provisional patent application Ser. No. 62/976,049 suffers from a disadvantage of not able to adjust the warm turbine to cold turbine flow ratio to achieve the optimal ratio when demand for LNG and LIN changes.

Varying demands of LNG and LIN in co-production natural gas liquefaction plants is common. For example, small peak shaver LNG plants are located strategically on natural gas pipelines and configured to store natural gas as LNG during the months when it is less expensive, and to return the natural gas to the pipeline when price and demand peaks, most often during cold winter weather and hot summer weather. These facilities produce LNG at maximum levels for part of the year and produce little or no LNG for the rest of the year. Co-production of LIN in such plants may be beneficial in strategic locations where demand for merchant LIN or back-up LIN is required. Of course, the potential for variation in merchant LIN demand and back-up LIN demand near a given LNG location can lead to wide changes in demand for LIN production.

Nitrogen liquefiers are typically capable of efficient turndown over a very broad range. Turndown to about 20% of capacity is achievable at reasonably good efficiency. Turndown is accomplished naturally by keeping the turbine nozzles unchanged. As the liquefier is turned down, the feed nitrogen flow is reduced and the pressure levels within the liquefier fall commensurately.

As a result, the volumetric flows through the turbines, their respective boosters, and the recycle compressor remains unchanged at their design rates. The pressure ratios across the machines also remain unchanged. So, while the machines become more unloaded, they each continue to operate essentially at their ideal design point. This means that the aerodynamic efficiencies of the rotating machines remain unchanged. The feed gas compressor is an exception to this, as it must be turned down with guide vanes or a suction throttle valve due to its lower flow and discharge pressure, with a constant supply pressure. The power demand of the recycle compressor is much larger than that of the feed gas compressor, though. So, it doesn't have a very large effect. Other than this, the only penalties for turndown are those associated with the mechanical and motor losses of the rotating machinery (which increase as a proportion of the total power consumption at turndown), and a significant thermodynamic penalty for the lower pressure liquefaction of nitrogen. This thermodynamic penalty occurs because at lower pressures, and particularly below its critical point pressure, the liquefaction of nitrogen results in a more thermodynamically irreversible temperature profile. The larger temperature invariant zones at lower nitrogen liquefaction pressures result in both tight pinch deltaT (ΔT) values and large deltaT (ΔT) values.

What is needed, therefore is a liquefier arrangement capable of co-production of LNG and LIN that is capable of operating in in distinct modes so as to enhance the independent turndown capability as the demand for LNG and LIN products change.

SUMMARY OF THE INVENTION

The present invention may be characterized as a system and/or method for liquefaction to co-produce liquid nitrogen and liquid natural gas that is configured to operate in two different operating modes, including a normal production mode and a turndown production mode. The present systems and/or methods are generally configured to receive a gaseous nitrogen feed stream; compress the gaseous nitrogen feed stream and one or more gaseous nitrogen recycle streams in a recycle compressor to produce a gaseous nitrogen effluent stream; further compress a first portion of the effluent stream in a cold booster compressor and a second portion of the effluent stream in a warm booster compressor in parallel or alternatively to further compress the effluent stream in a warm booster compressor and a cold booster compressor arranged in series; cool a primary nitrogen liquefaction exiting one or both booster compressors stream in a first heat exchange passage in a multi-pass brazed aluminum heat exchanger (BAHX); expand a first portion of the cooled primary nitrogen liquefaction stream extracted at a primary intermediate location of the first heat exchange passage in a cold booster loaded turbine to produce a cold turbine exhaust; warm the cold turbine exhaust and a warm turbine exhaust in one or more heat exchange passages in the multi-pass brazed aluminum heat exchanger, including at least a second heat exchange passage to produce one or more gaseous nitrogen recycle streams; subcool the primary nitrogen liquefaction stream to produce the subcooled liquid nitrogen stream; liquefy a natural gas feed stream in a fifth heat exchange passage of the multi-pass brazed aluminum heat exchanger against a first portion of the at least partially vaporized subcooled liquid nitrogen stream in a fourth heat exchange passage of the multi-pass brazed aluminum heat exchanger to produce the liquid natural gas; and taking a second portion of the subcooled liquid nitrogen stream as the liquid nitrogen.

In a first operating mode, the systems and/or methods are configured such that the second portion of the effluent stream compressed in the warm booster compressor is partially cooled in a third heat exchange passage and subsequently expanded in the warm booster loaded turbine to produce the warm turbine exhaust. The warm turbine exhaust is then directed back to one or more heat exchange passages in the multi-pass brazed aluminum heat exchanger to produce at least one of the one or more gaseous nitrogen recycle streams.

In a second operating mode, typically a turndown operating mode, the systems and/or methods are configured such that a third portion of the effluent stream is partially cooled in the third heat exchange passage and subsequently expanded in the warm booster loaded turbine to produce the warm turbine exhaust. As with the first mode, the warm turbine exhaust is then directed back to one or more heat exchange passages in the multi-pass brazed aluminum heat exchanger to produce at least one of the one or more gaseous nitrogen recycle streams.

In some embodiments, the natural gas feed stream is compressed or otherwise pre-conditioned prior to the step of liquefying the natural gas feed stream in the fifth heat exchange passage of the multi-pass brazed aluminum heat exchanger. Also, in some embodiments, the liquid nitrogen may be expanded using a liquid turbine disposed downstream of the multi-pass brazed aluminum heat exchanger or a throttle valve disposed downstream of the multi-pass brazed aluminum heat exchanger.

The exact configuration or arrangement of the BAHX may be modified to optimize the performance of the liquefaction system and method. For example, the extraction of the first portion of the cooled primary nitrogen liquefaction stream at the primary intermediate location of the first heat exchange passage is preferably extracted at a temperature colder than the temperature of the warm exhaust stream re-introduced to the BAHX.

Another possible configuration of the BAHX would be to send the warm turbine exhaust and the cold turbine exhaust to the same heat exchange passage of the BAHX or to separate heat exchange passages (e.g. the warm turbine exhaust is warmed in a sixth heat exchange passage while the cold turbine exhaust is warmed in a second heat exchange passage of the multi-pass BAHX.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawings in which:

DETAILED DESCRIPTION

Turning now to the drawings, there are shown four different embodiments of the present system and method for the liquefaction of both LNG and LIN configured to operate in two distinct operating modes. In each of the illustrated embodiments, a common and key feature is the flexibility of the further compressed stream exiting the warm booster compressor to be used as part of the primary nitrogen liquefaction stream or to be used as part of the nitrogen recycle stream. In a first operating mode, the compressed nitrogen stream exiting the warm booster compressor is cooled in a separate passage of the main heat exchanger, expanded in the warm turbine and returned as part of the nitrogen recycle stream supply refrigeration to the primary nitrogen liquefaction stream. In a second turndown operating mode, the compressed nitrogen stream exiting the warm booster compressor is diverted to be part of the primary nitrogen liquefaction stream while a third portion of the compressed nitrogen stream is diverted upstream of the warm booster compressor and cooled in the separate passage of the main heat exchanger, expanded in the warm turbine and subsequently returned as part of the nitrogen recycle stream.

Figure 1:
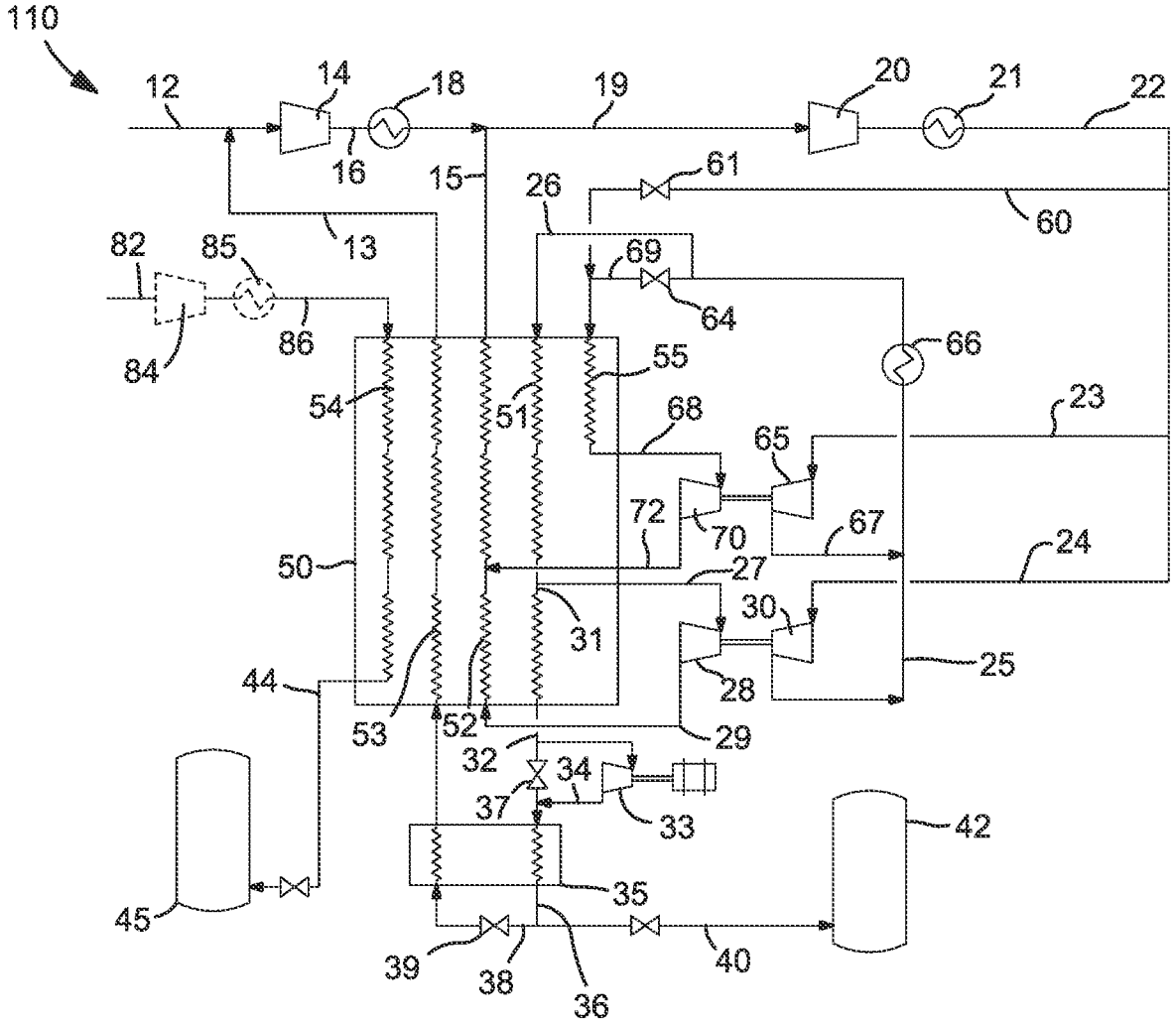
FIG. 1 is a schematic diagram of a liquefier capable of co-producing LNG and LIN in accordance with an embodiment of the present system and method.

FIG. 1 shows a first embodiment of the present system and method in which a feed stream of gaseous nitrogen 12 and a purified and compressed natural gas feed stream 82 are introduced into the liquefier arrangement 100. The gaseous nitrogen feed 12 is preferably originates from distillation columns in a co-located or closely located air separation unit (not shown). The gaseous nitrogen feed 12 is compressed in a feed gas compressor 14 and the compressed nitrogen feed stream 16 is then cooled in aftercooler 18. The compressed nitrogen feed stream 16 is combined with the recycle stream 15 and further compressed in a recycle compressor 20 and subsequently cooled in aftercooler 21. The further compressed nitrogen feed stream 22 is split with a first portion 24 of the cooled compressed nitrogen feed stream is directed to a cold booster compressor 30 to produce a cold booster discharge stream 25. A second portion 23 of the cooled compressed nitrogen feed stream directed to a warm booster compressor 65 where it is compressed to produce a warm booster discharge stream 67. An optional third portion 60 of the cooled compressed nitrogen feed stream may be directed via valve 61 to the warm turbine circuit, as discussed in more detail below.

The warm booster discharge stream 67 and the cold booster discharge stream 25 are combined and subsequently cooled in aftercooler 66 to remove the heat of compression generated from the warm booster compressor 65 and the cold booster compressor 30. The combined stream may be further split with a first part of the combined stream being the primary nitrogen liquefaction stream 26 and a second part 69 of the combined stream optionally diverted via valve 64 to the warm turbine circuit, as discussed in more detail below.

The primary nitrogen liquefaction stream 26 is directed to a first heat exchange passage 51 in a brazed aluminum heat exchanger (BAHX) 50 for cooling to temperatures suitable for nitrogen liquefaction. A first portion 27 of the primary nitrogen liquefaction stream in the first heat exchange passage 51 of the BAHX 50 is extracted at an intermediate location of the first heat exchange passage 51 and directed to the booster loaded cold turbine 28 where the first extracted portion 27 is expanded to produce a cold turbine exhaust 29. The cold turbine exhaust 29 is then directed to the cold end of a second heat exchange passage 52 in the BAHX 50. The cold turbine exhaust 29 is then warmed in the BAHX 50 and the warmed exhaust 15 is recycled to the compressed nitrogen feed stream 19.

A second portion 31 of the primary nitrogen liquefaction stream continues through the BAHX 50 to produce a liquid nitrogen stream 32. The liquid nitrogen stream 32 is optionally diverted to a generator loaded liquid turbine 33 where it is expanded to produce a liquid turbine exhaust stream 34. The liquid turbine exhaust stream 34 is directed to subcooler 35 configured to produce a subcooled liquid nitrogen stream 36. The use of the generator loaded liquid turbine 33 shown in in the drawings is optional. Use of the liquid turbine likely depends on the power savings that the liquid turbine provides relative to the cost of electricity at a given installation site. In lieu of using the generator loaded liquid turbine 33, the liquid nitrogen stream 32 may proceed directly to subcooler 35 via control valve 37.

A first portion 38 of the subcooled liquid nitrogen stream is routed back via valve 39 through another passage of the subcooler 35 and then to a fourth heat exchange passage 53 of BAHX 50 to provide the requisite cooling for the nitrogen and natural gas streams. The resulting recycle stream 39 exiting the warm end of the fourth heat exchange passage 53 is recycled as stream 13 to the gaseous nitrogen feed stream 12. A second portion of the subcooled liquid nitrogen stream is the liquid nitrogen product stream 40 preferably directed to a liquid nitrogen product storage tank 42.

The purified, natural gas feed stream 82 is received from a source of natural gas (not shown) and is optionally compressed in natural gas compressor 84 and optionally cooled in aftercooler 85. The conditioned natural gas feed 86 is then directed to a fifth heat exchange passage 54 in BAHX 50 where it is cooled to temperatures suitable for liquefaction of natural gas. The LNG stream 44 existing the fifth heat exchange passage 54 in BAHX 50 is sent to LNG storage tank 45.

Nitrogen gas flow through the warm turbine circuit in the embodiment shown in FIG. 1 differs based on the operating mode selected. In a first operating mode where the liquefier is operating at or near full capacity, valve 64 is open and valve 61 is closed. In this first operating mode, the nitrogen gas flow to the warm turbine circuit is comprised of the second portion 69 of the combined stream via open valve 64 while the optional third portion 60 of the cooled compressed nitrogen feed stream is blocked as valve 61 is closed. The second portion 69 of the combined stream is directed to a third heat exchange passage 55 in the BAHX 50 where it is partially cooled. The partially cooled refrigerant stream 68 is extracted from the third heat exchange passage 55 of BAHX 50 at an intermediate location and directed to the booster loaded warm turbine 70 where it is expanded. The exhaust stream 72 from the booster loaded warm turbine 70 is returned to an intermediate location of the second heat exchange passage 52 in the BAHX 50 where it is warmed with the warmed exhaust stream 15 being recycled to the compressed nitrogen feed stream 19.

In a second operating mode where the liquefier is operating in response to a large turndown in LNG production, valve 64 is closed and valve 61 is open. In this second operating mode, the nitrogen gas flow to the warm turbine circuit is comprised of the third portion 60 of the cooled compressed nitrogen feed stream via open valve 61 while the second part 69 of the combined stream is blocked as valve 64 is closed. The third portion 60 of the cooled compressed nitrogen feed stream is directed to the third heat exchange passage 55 in the BAHX 50 where it is partially cooled. Similar to the first operating mode, the partially cooled refrigerant stream 68 is extracted from the third heat exchange passage 55 of BAHX 50 at an intermediate location and directed to the booster loaded warm turbine 70 where it is expanded. The exhaust stream 72 from the booster loaded warm turbine 70 is returned to an intermediate location of the second heat exchange passage 52 in the BAHX 50 where it is warmed with the warmed exhaust stream 15 being recycled to the compressed nitrogen feed stream 19.

In the second operating mode, the booster loaded warm turbine 70 now is supplied directly from the recycle compressor 20, while the booster loaded cold turbine 28 is supplied similar to the first operating mode from the first portion 27 of the primary nitrogen liquefaction stream The discharge configuration of the both the booster loaded warm turbine 70 and the booster loaded cold turbine 28 is unchanged, so the discharge pressure of the turbines remains similar to each other. It should be noted, however, that the operating parameters of the rotating machinery, especially the pressure ratio across the booster loaded warm turbine 70, in the second operating mode is significantly reduced and the mass flow to the warm booster compressor 65 is lower, which may limit the rangeability of this embodiment when operating in turndown mode. In other words, the present liquefier arrangement 10 provides two specific operating modes with a limited range of operation but provides the advantage of improved design simplicity and the ease of changing from one operating mode to another operating mode.

Figure 2:
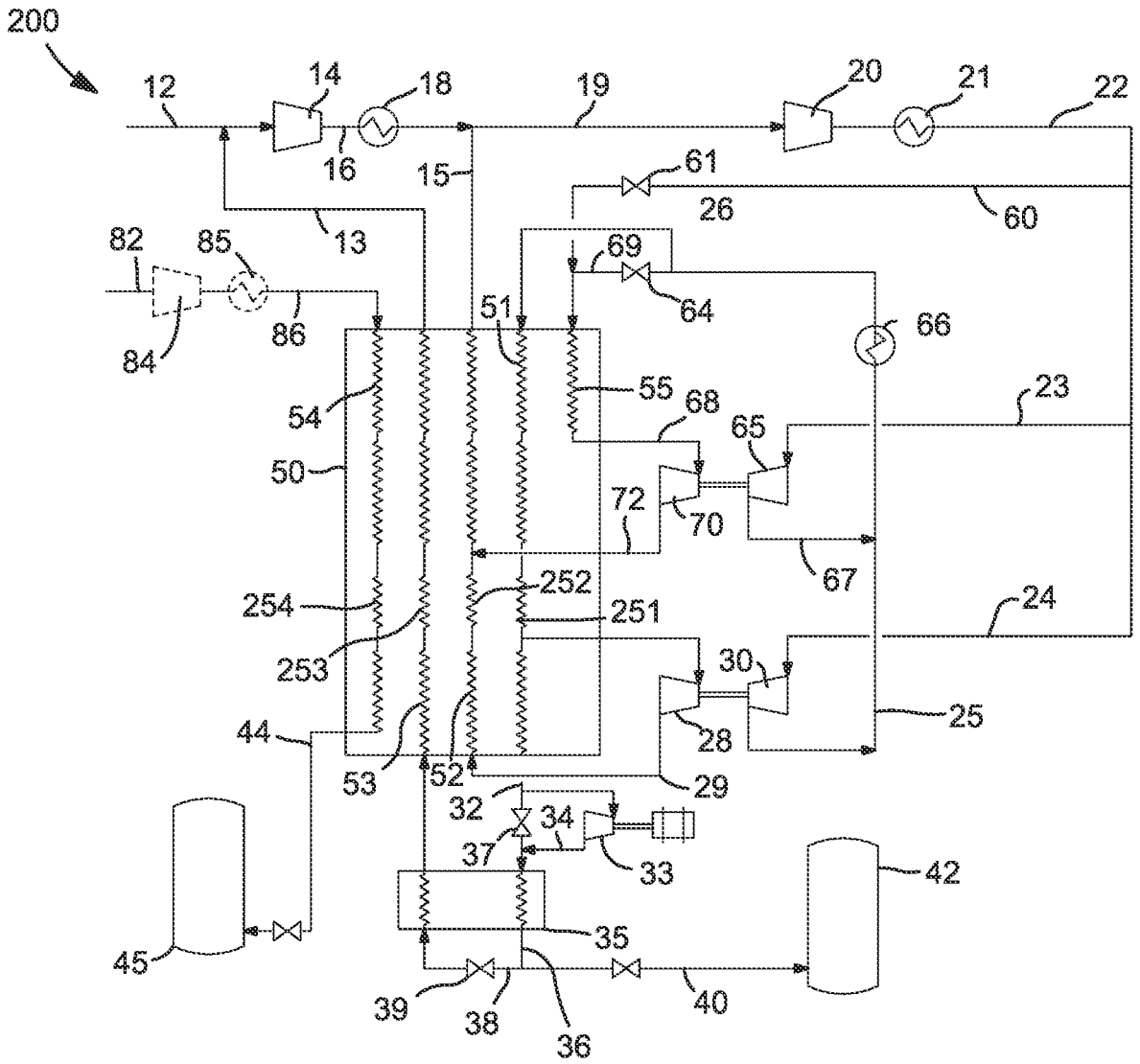
FIG. 2 is a schematic diagram of a liquefier capable of co-producing LNG and LIN in accordance with another embodiment of the present system and method that is a variant of the embodiment shown in FIG. 2 with additional heat exchange zones disposed between the warm turbine and the cold turbine.

When operating in turndown or the second operating mode, the temperature change across the booster loaded warm turbine is also decreased due to the lower pressure ratio of the booster loaded warm turbine. The embodiment shown in FIG. 2 provides an arrangement that compensates for the temperature differences. The embodiment of FIG. 2 is in many ways the same or similar to the embodiment of FIG. 1 except that the heat exchange passages in the BAHX are extended to include an additional zones of heat exchange.

As many of the components and streams in the embodiment of FIG. 2 are the same as in the embodiment of FIG. 1, the drawings use the same reference numerals and the descriptions thereof will not be repeated. These additional extended zones 251, 252, 253 and 254 are added between the warm turbine exhaust and the cold turbine feed. This liquefier arrangement 200 allows the further warming of the return streams such that they approximately match the warm turbine exhaust temperature. The efficiency loss of mixing a warm turbine stream that is significantly warmer than the return stream is thus avoided.

Figure 3:
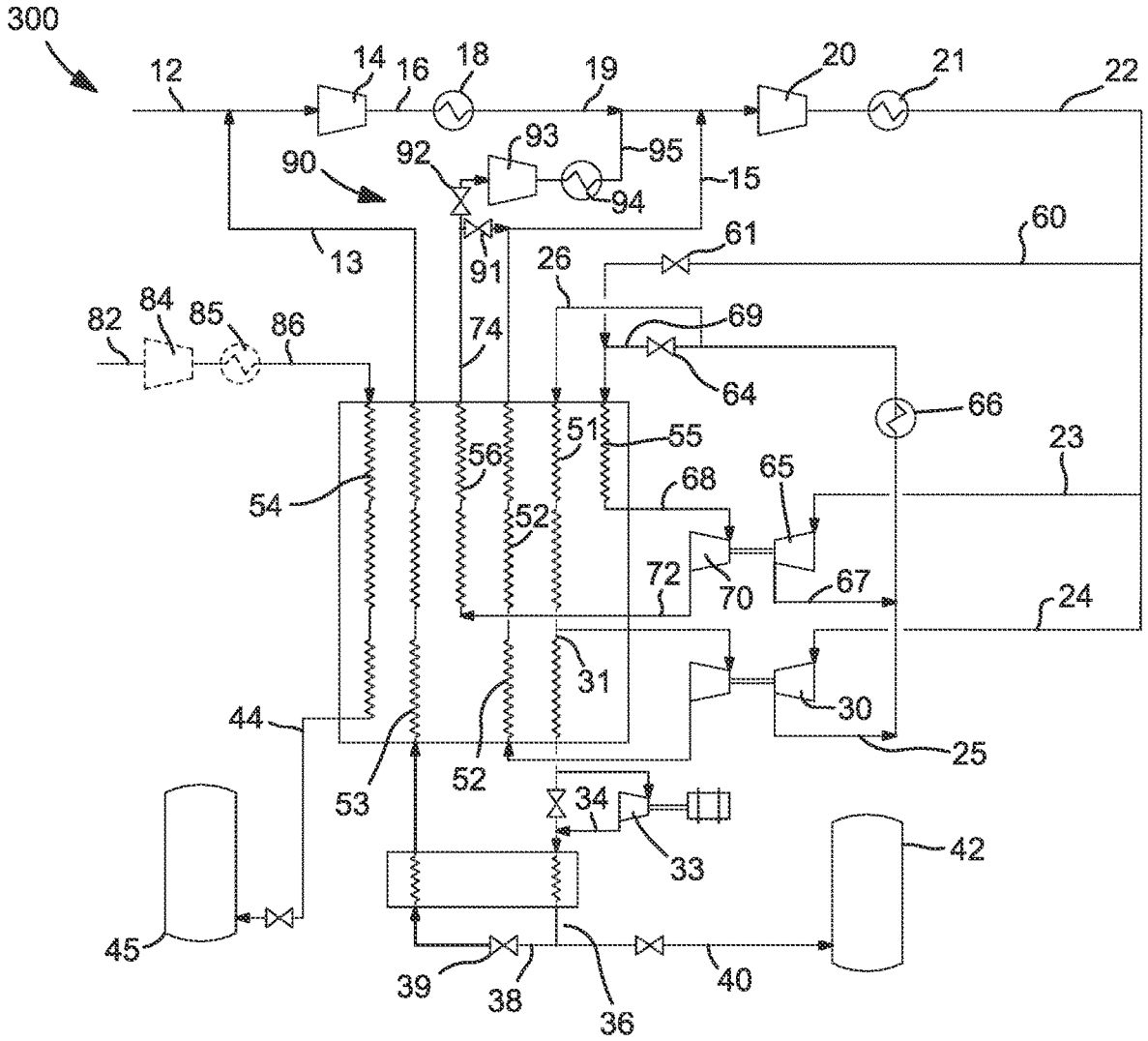
FIG. 3 is a schematic diagram of a liquefier capable of co-producing LNG and LIN in accordance with yet another embodiment of the present system and method with an additional circuit for handling the discharge of the warm turbine.

Turning now to FIG. 3, there is shown a third embodiment of the present liquefier arrangement 300 that improves efficient rangeability over the embodiment of FIG. 1. As many of the components and streams in the embodiment of FIG. 3 are the same as in the embodiment of FIG. 1, the drawings use the same reference numerals and the descriptions thereof will not be repeated. The key differences between the embodiment of FIG. 1 and that of FIG. 3 is the addition of a sixth heat exchange passage 56 in the BAHX 50, a warm turbine exhaust circuit 90, including valves 91 and 92, a warm recycle compressor 93, and aftercooler 94.

Similar to the embodiment of FIG. 1, the embodiment of FIG. 3 operates in several different operating modes. In a first operating mode when the liquefier is operating at or near full capacity, valve 64 is open and valve 61 is closed. In this first operating mode, the nitrogen gas flow to the warm turbine circuit is comprised of the second portion 69 of the combined stream via open valve 64 while the optional third portion 60 of the cooled compressed nitrogen feed stream is blocked as valve 61 is closed. The second portion 69 of the combined stream is directed to the third heat exchange passage 55 in the BAHX 50 where it is partially cooled. The partially cooled refrigerant stream 68 is extracted from the third heat exchange passage 55 of BAHX 50 at an intermediate location and directed to the booster loaded warm turbine 70 where it is expanded. The exhaust stream 72 from the booster loaded warm turbine 70 is returned to an intermediate location of the sixth heat exchange passage 56 in the BAHX 50 and recycled to the compressed nitrogen feed stream 19 via open valve 91 while valve 92 remains closed.

In the second operating mode when LNG production is turned down significantly, valve 92 is opened and valve 91 is closed. In this second operating mode, the exhaust stream 72 from the booster loaded warm turbine 70 is at a lower pressure and the lower pressure exhaust stream 72 is returned to the intermediate location of the sixth heat exchange passage 56 in the BAHX 50. The warmed, lower pressure exhaust stream 74 is recycled to the compressed nitrogen feed stream 19 via open valve 92 and further compressed in the warm recycle compressor 93 and cooled in aftercooler 94 prior to joining the compressed nitrogen feed stream 19.

Warm recycle compressor 93 is preferably a single stage compressor and it would preferably be coupled to the same bull-gear and drive motor as the main recycle compressor. In the first operating mode when the liquefier arrangement is operating at or near full capacity, the warm recycle compressor is bypassed and/or out of operation. This configuration allows a wider range of efficient operation compared to the embodiment shown in FIG. 1.

By employing the additional passage in the BAHX and the warm recycle compressor, the discharge or exhaust stream of the booster loaded warm turbine, its pressure ratio and its volume flow can be similar in both the first operating mode and the second operating mode, which enables more efficient operation and potentially, a greater range of efficient turndown of LNG production.

Figure 4:
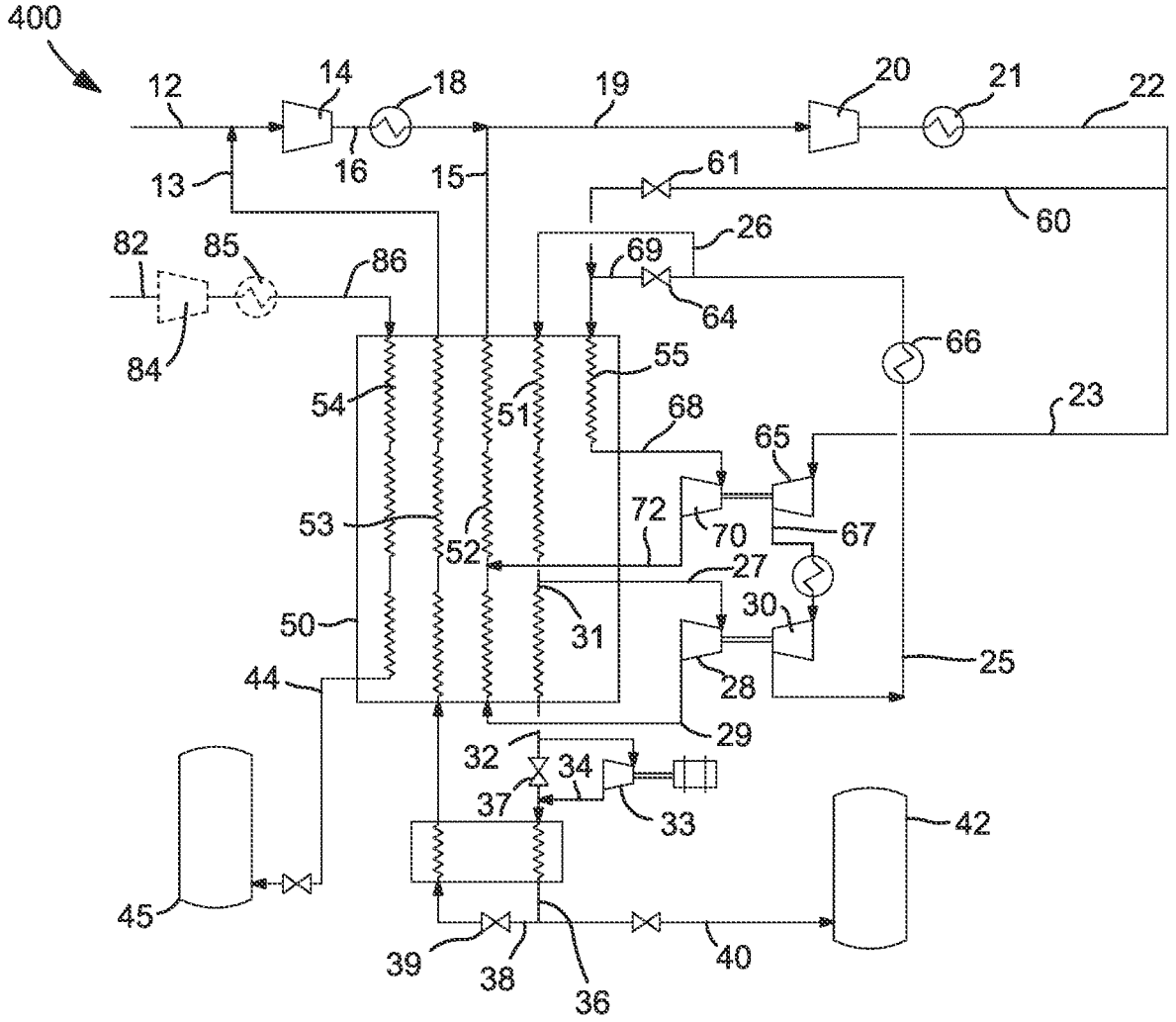
FIG. 4 is a schematic diagram of a liquefier capable of co-producing LNG and LIN in accordance with still another embodiment of the present system and method with the warm booster and cold booster configured to operate in series.

Turning now to FIG. 4, there is shown a fourth embodiment of the present liquefier arrangement 400 that provides a more efficient turndown operation compared to the embodiment of FIG. 1. As many of the components and streams in the embodiment of FIG. 4 are the same as in the embodiment of FIG. 1, the drawings again use the same reference numerals and the descriptions thereof will not be repeated. The key differences between the embodiment of FIG. 1 and that of FIG. 4 is the arrangement of the warm booster compressor 65 and cold booster compressor 30.

In contrast to the liquefier arrangement of FIG. 1 which is configured to split the further compressed nitrogen feed stream 22 into a first portion 24 directed to the cold booster compressor 30 and second portion 23 that is directed to the warm booster compressor 65 and the liquefier arrangement 400 of FIG. 4 is configured so that the warm booster compressor 65 and the cold booster compressor 30 operate in series. The further compressed nitrogen feed stream 23 is supplied first to the warm booster compressor 65 where it is compressed to a moderate pressure level and then directed to the cold booster compressor 30 where it is compressed to a higher pressure level. In this serial arrangement of the booster compressors the volumetric flow to the warm booster compressor is maximized, rangeability is improved, and operational efficiency even in LNG turndown mode may be improved compared to the liquefier arrangement shown in FIG. 1.

While the present invention has been described with reference to several preferred embodiments, it is understood that numerous additions, changes and omissions can be made without departing from the spirit and scope of the present system and method for natural gas and nitrogen liquefaction as set forth in the appended claims.

What is claimed is:

1. A method of liquefaction to co-produce liquid nitrogen and liquid natural gas, the method comprising the steps of:

(i) receiving a gaseous nitrogen feed stream;

(ii) compressing the gaseous nitrogen feed stream and one or more gaseous nitrogen recycle streams in a recycle compressor to produce a gaseous nitrogen effluent stream;

(iii) further compressing a first portion of the effluent stream in a cold booster compressor to form a cold booster discharge stream;

(iv) further compressing a second portion of the effluent stream in a warm booster compressor to form a warm booster discharge stream;

(v) combining the cold booster discharge stream and the warm booster discharge stream to form a primary nitrogen liquefaction stream;

(vi) cooling the primary nitrogen liquefaction stream in a first heat exchange passage in a multi-pass brazed aluminum heat exchanger to produce a liquid nitrogen stream exiting the first heat exchange passage at a cold-end location;

(vii) withdrawing a first portion of the cooled primary nitrogen liquefaction stream from a primary intermediate location of the first heat exchange passage and expanding the first portion of the cooled primary nitrogen liquefaction stream in a cold booster loaded turbine to produce a cold turbine exhaust;

(viii) warming the cold turbine exhaust and a warm turbine exhaust in one or more heat exchange passages in the multi-pass brazed aluminum heat exchanger, including at least a second heat exchange passage to produce one or more gaseous nitrogen recycle streams;

(ix) subcooling the liquid nitrogen stream exiting the first heat exchange passage at the cold-end location in a subcooler to produce a subcooled liquid nitrogen stream;

(x) vaporizing or partially vaporizing a first portion of the subcooled liquid nitrogen stream in the subcooler;

(xi) liquefying a natural gas feed stream in a fifth heat exchange passage of the multi-pass brazed aluminum heat exchanger against the vaporized or partially vaporized subcooled liquid nitrogen stream in a fourth heat exchange passage of the multi-pass brazed aluminum heat exchanger and the one or more gaseous nitrogen recycle streams to produce the liquid natural gas; and (xii) taking a second portion of the subcooled liquid nitrogen stream as the liquid nitrogen product stream;

wherein in a first operating mode the method further comprises the steps of: (a) diverting a portion of the primary nitrogen liquefaction stream to form a diverted second part stream and cooling the diverted second part stream in a third heat exchange passage in the multi-pass brazed aluminum heat exchanger; (b) expanding the cooled, diverted second part stream exiting the third heat exchange passage in a warm booster loaded turbine to produce the warm turbine exhaust; and (c) warming the warm turbine exhaust in the one or more heat exchange passages to produce at least one of the one or more gaseous nitrogen recycle streams; and wherein in a second operating mode the method further comprises the steps of: (d) cooling a third portion of the effluent stream in the third heat exchange passage; (e) expanding the cooled, third portion of the effluent stream in the warm booster loaded turbine to produce the warm turbine exhaust; and (f) warming the warm turbine exhaust in the one or more heat exchange passages to produce at least one of the one or more gaseous nitrogen recycle streams.

2. The method of claim 1 further comprising the step of compressing the natural gas feed stream prior to the step of liquefying the natural gas feed stream in the fifth heat exchange passage of the multi-pass brazed aluminum heat exchanger.

3. The method of claim 1 further comprising the step of expanding the liquid nitrogen stream exiting the first heat exchange passage at the cold-end location in a liquid turbine disposed downstream of the multi-pass brazed aluminum heat exchanger or a throttle valve disposed downstream of the multi-pass brazed aluminum heat exchanger.

4. The method of claim 1 wherein the extraction of the first portion of the cooled primary nitrogen liquefaction stream at the primary intermediate location of the first heat exchange passage is at a temperature colder than the temperature of the warm exhaust stream introduced to the second heat exchange passage.

5. The method of claim 1 wherein the step of warming the cold turbine exhaust and the warm turbine exhaust in one or more heat exchange passages in the multi-pass brazed aluminum heat exchanger further comprises;

warming the warm turbine exhaust in a sixth heat exchange passage in the multi-pass brazed aluminum heat exchanger; and warming the cold turbine exhaust in the second heat exchange passage of the multi-pass brazed aluminum heat exchanger.

6. The method of claim 5 further comprising the steps of:

directing the warm turbine exhaust in the sixth heat exchange passage to a warm turbine exhaust circuit;

compressing the warmed stream exiting the sixth heat exchange passage in a warm recycle compressor to form one of the one or more gaseous nitrogen recycle streams; and recycling the compressed stream exiting the warm recycle compressor to the gaseous nitrogen feed stream.

7. A method of liquefaction to co-produce liquid nitrogen and liquid natural gas, the method comprising the steps of:

(i) receiving a gaseous nitrogen feed stream;

(ii) compressing the gaseous nitrogen feed stream and one or more gaseous nitrogen recycle streams in a recycle compressor to produce a gaseous nitrogen effluent stream;

(iii) further compressing a first portion of the effluent stream in a warm booster compressor and a cold booster compressor to form a primary nitrogen liquefaction stream;

(iv) cooling all or a portion of the primary nitrogen liquefaction stream in a first heat exchange passage in a multi-pass brazed aluminum heat exchanger to produce a liquid nitrogen stream exiting the first heat exchange passage at a cold-end location;

(v) withdrawing a first portion of the cooled primary nitrogen liquefaction stream from a primary intermediate location of the first heat exchange passage and expanding the first portion of the cooled primary nitrogen liquefaction stream in a cold booster loaded turbine to produce a cold turbine exhaust;

(vi) warming the cold turbine exhaust and a warm turbine exhaust in one or more heat exchange passages in the multi-pass brazed aluminum heat exchanger, including at least a second heat exchange passage to produce one or more gaseous nitrogen recycle streams;

(vii) subcooling the liquid nitrogen stream exiting the first heat exchange passage at the cold-end location in a subcooler to produce a subcooled liquid nitrogen stream;

(viii) vaporizing or partially vaporizing a first portion of the subcooled liquid nitrogen stream in the subcooler;

(ix) liquefying a natural gas feed stream in a fifth heat exchange passage of the multi-pass brazed aluminum heat exchanger against the vaporized or partially vaporized subcooled liquid nitrogen stream in a fourth heat exchange passage of the multi-pass brazed aluminum heat exchanger and one or more gaseous nitrogen recycle streams to produce the liquid natural gas; and (ix) taking a second portion of the subcooled liquid nitrogen stream as the liquid nitrogen product stream;

wherein in a first operating mode the method further comprises the steps of: (a) diverting a portion of the primary nitrogen liquefaction stream to form a diverted second part stream and cooling the diverted second part stream in a third heat exchange passage in the multi-pass brazed aluminum heat exchanger; (b) expanding the cooled, diverted second part stream exiting the third heat exchange passage in a warm booster loaded turbine to produce the warm turbine exhaust; and (c) warming the warm turbine exhaust in the one or more heat exchange passages to produce at least one of the one or more gaseous nitrogen recycle streams; and wherein in a second operating mode the method further comprises the steps of: (d) cooling a third portion of the effluent stream in the third heat exchange passage; (e) expanding the cooled, third portion of the effluent stream in the warm booster loaded turbine to produce the warm turbine exhaust; and (f) warming the warm turbine exhaust in the one or more heat exchange passages to produce at least one of the one or more gaseous nitrogen recycle streams.

8. The method of claim 7 further comprising the step of compressing the natural gas feed stream prior to the step of liquefying the natural gas feed stream in the fifth heat exchange passage of the multi-pass brazed aluminum heat exchanger.

9. The method of claim 7 further comprising the step of expanding the liquid nitrogen stream exiting the first heat exchange passage at the cold-end location in a liquid turbine disposed downstream of the multi-pass brazed aluminum heat exchanger or a throttle valve disposed downstream of the multi-pass brazed aluminum heat exchanger.

10. The method of claim 7 wherein the extraction of the first portion of the cooled primary nitrogen liquefaction stream at the primary intermediate location of the first heat exchange passage is at a temperature colder than the temperature of the warm exhaust stream introduced to the second heat exchange passage.

11. The method of claim 7 wherein the step of warming the cold turbine exhaust and the warm turbine exhaust in one or more heat exchange passages in the multi-pass brazed aluminum heat exchanger further comprises;

warming the warm turbine exhaust in a sixth heat exchange passage in the multi-pass brazed aluminum heat exchanger; and warming the cold turbine exhaust in the second heat exchange passage of the multi-pass brazed aluminum heat exchanger.

* * * * *